United States Patent [19]

Tanaka

[11] Patent Number: 4,952,912

[45] Date of Patent: Aug. 28, 1990

[54] ALARM SYSTEM

[75] Inventor: Tsuginobu Tanaka, Tokyo, Japan

[73] Assignee: Tanaka Denki Koondo Co., Ltd., Japan

[21] Appl. No.: 336,584

[22] Filed: Apr. 11, 1989

[30] Foreign Application Priority Data

Jan. 12, 1989 [JP] Japan ..... 1-002473

[51] Int. Cl.[5] ..... G08B 13/14; G08B 23/00

[52] U.S. Cl. ..... 340/568; 340/527; 340/652

[58] Field of Search ..... 340/652, 568, 527

[56] References Cited

U.S. PATENT DOCUMENTS

| | | | |
|---|---|---|---|
| 4,028,691 | 6/1977 | Zeder | 340/568 |
| 4,151,506 | 4/1979 | Schoenmetz | 340/568 |
| 4,284,983 | 8/1981 | Lent | 340/568 |
| 4,300,130 | 11/1981 | Fotheringham | 340/568 |
| 4,658,242 | 4/1987 | Zeder | 340/568 |

FOREIGN PATENT DOCUMENTS 63-47988 12/1988 Japan .

*Primary Examiner*—Joseph A. Orsino
*Assistant Examiner*—Kinfe-Michael Negash
*Attorney, Agent, or Firm*—Lowe, Price, LeBlanc, Becker & Shur

[57] ABSTRACT

An alarm system comprises of a closed circuit includes an alarm cord connected to a DC power source, a disconnect signal detector having an inverter circuit and a thyristor and a push-button switch. An alarm generator produces an alarm sound by the detection signal from the disconnect signal detector. A first charging-discharging circuit is connected to the DC power source through a first transistor which is turned on when the push-button switch is depressed, and a first Schmitt trigger circuit transmits a connect signal to the disconnect signal detector only for a time period set by the first charging-discharging circuit. The Schmitt trigger circuit transmits a disconnect signal to the disconnect signal detector after the setting period determined by the first charging-discharging circuit. A second charging-discharging circuit is connected to the DC power source through a second transistor to be turned on when the push-button switch is depressed, and a second Schmitt trigger circuit transmits a signal to cause the alarm generator to produce the alarm sound to indicate the start of alarm cancellation only for a time period set by the second charging-discharging circuit. The first and the second charging-discharging circuits constituting the timers can be energized by the current flowing through the first and the second transistors, respectively. The period of time of the cancellation mode and the period of time producing the alarm cancellation start sound at the time of the cancellation are set by the first and the second charging-discharging circuits, respectively.

1 Claim, 2 Drawing Sheets

ALARM SYSTEM

BACKGROUND OF THE INVENTION

The present invention relates to an alarm system wherein an alarm cord is attached to items to be guarded, such as goods displayed at a store front, or doors or windows, so that an alarm sound can be produced by a disconnection detection signal when the alarm cord is disconnected.

The present applicant has previously proposed another similar alarm system (refer to Utility Model Publication No. 63-47988 in Japan). The alarm system has a composition as is shown in FIG. 2 and the following functions.

The alarm process will be reviewed first. Alarm cord 6 is passed through, for example, the grips 4a, 4b and 4c sequentially with both ends of the cord connected to power source terminal 11 to apply DC voltage Vcc to closed circuit 11 consisting of the alarm cord 6, high resistor 8, protective resistor 9 and LED 10, whereby the alarm system is set to the alarm mode. In this case, the value of the DC voltage Vcc is small, but the value of the high resistor 8 is as large as several MΩ, so that the alarm current is as low as 2–6 μA, and the LED 10 remains unlit. Also, in this alarm mode, both the connection terminals 3 and 7 are at H-level, and thus the output side of inverter circuit 47 is a L-level, and thyristor 48 is left turned off. Inverter circuit 47 is included in a disconnect signal detector 12.

If anyone attempting to steal some goods disconnects the alarm cord 6 or connector 5, this causes the alarm current to be interrupted to cause the level of connection terminal 7 to be changed to L-level whereas the level of the output side of inverter circuit 47 is caused to be changed to H-level to turn on thyristor 48. This causes the output side of the inverter circuit 53 to be set to H-level, whereby the H-level signal is inputted to the alarm generator 21 through diode 54 to drive the first and second oscillation circuits 27 and 33 and transistor 56. This then causes the vibrator (buzzer) 34 of piezoelectric element to be actuated to give an alarm to the store clerks, etc. In this case, even if the disconnected alarm cord 6 or the connecter 5 is reconnected in haste to set the gate of the thyristor to the L-level, the thyristor continues to remain turned on to keep the H-level signal being transmitted to the alarm generator 21, and so the vibrator 34 is kept operating to continue alarming. The current to the thyristor 48 is discontinued only when a movable member 51 of momentary non-locking switch 52 is depressed to cause the movable member to come into contact with constantly opened contact 55, since this causes the thyristor 48 to be turned off to stop the alarm sound.

Secondly, the process of the alarm cancellation necessary when disconnecting the connector 5 to deliver the goods to the customer will be reviewed. First, the movable member of the momentary non-locking switch 52 has to be depressed lightly and released quickly. This causes the movable member 51 of the momentary non-locking switch 52 to contact the constantly opened contact 55, whereby DC voltage Vcc is applied to a charging-discharging circuit 39 of an alarm cancellation signal generator 35 to cause capacitor 38 to charge instantaneously and the movable member 51 to return automatically to the constantly closed contact 49. When the charge of the capacitor 38 is discharged, the partial voltage at both ends of resistor 37, one of discharge resistors 36 and 37 connected in series, actuates the alarm generator 21 through diode 46 in order to indicate the start of cancellation for a short period of time t' (ex. t'=2–3 seconds) only while the partial voltage is at H-level.

Also, at the time of the discharging of the capacitor 38, the output side of Schmitt trigger circuit 45 is set to H-level during a period t (ex. t=4–10 seconds>t') through which the voltage across the discharge capacitors 36 and 37 is at H-level, whereby LED 10 is lit to indicate that the alarm is cancelled, and the output side of the inverter circuit 47 in disconnect signal detector 12 is kept at L-level. Thus, during the period t' regardless of whether the alarm cord 6 is disconnected or not, the thyristor 48 is kept turned off, and so the alarm generator 21 will not be actuated.

Thus, the connector 5 should be disconnected to remove the article 4a, and the connector 5 should be reconnected. After this step, any special resetting operation is not required, since with the expiration of the time period t' the level of the output side of the Schmitt trigger circuit changes to L-level from H-level to restore the alarm state automatically. As explained previously, the vibrator 34 will not be actuated so long as the article 4a is removed and the alarm cord is reconnected during the time period t set by the capacitor 38 and the resistor 36 and 37 of the charging-discharging circuit 39. However, if the alarm cord 6 is not reconnected during the time period t' the vibrator 34 will be actuated. If the vibrator 34 is actuated, the movable member 51 of the momentary non-locking switch 52 should be caused to come into contact with the constantly opened contact 55 by being depressed so that the thyristor is turned off to stop the alarm sound.

As explained in the above, even if disconnecting the article 4a from the alarm cord 6 is delayed, and the alarm sound is produced as a result, the alarm sound can be stopped by operating the momentary non-locking switch, and the cancellation time t can be reset. Thus, even when the alarm sound is started because of delay in disconnecting the article 4a or by error, the alarm sound can be stopped immediately by operating the momentary non-locking switch 52.

When the cancellation time t has elapsed, the level of the cancellation signal outputted from the alarm cancellation signal generator 35 changes to L-level, and the signal is inputted to the gate of the thyristor 48 through the inverter circuit 47 to turn on the thyristor 48. As a result, the level of the signal on the anode side of the thyristor 48 becomes L-level, and the level of the signal becomes H-level in the inverter circuit 53. Then, the signal is inputted to the alarm generator 21 through switching diode 54 to restart the alarm sound. In this case, once the alarm sound is started, it continues, even if the alarm cord 6 and the connector 5 are reconnected, unless the thyristor 48 is turned off.

The alarm system described in the foregoing is capable enough to accomplish its object, but it has been learned that the alarm system still has the following points to be improved for its better performance.

Using the momentary non-locking switch directly for charging the charging-discharging circuit causes a large current to flow through the momentary non-locking switch, thereby requiring the use of large and more durable switches.

Using only one charging-discharging circuit for setting the time t' whereby the start of the alarm cancellation to be indicated and also for setting the time t (>t') whereby the state of the alarm cancellation is to be indicated causes the instabilities of the times for setting t and t'.

BRIEF SUMMARY OF THE INVENTION

An object of the present invention is thus to enable the use of smaller switches in an alarm system, and another object is to enable more accurate time setting.

The foregoing and other objects are effected by the present invention as will be apparent from the following description and claim taken in connection with the accompanying drawing, forming a part of this application.

In order to implement these and still further objects, the present invention comprises the following main components: a closed circuit consisting of an alarm cord 6, a high resistor 8 and a luminous element 10 which are connected in series sequence to a DC power source; a disconnect signal detector 12 is provided to output a detection signal when disconnection of the alarm cord is detected. The disconnect signal detector primarily includes an inverter circuit 47, a thyristor 48 and an automatic reset type push-button switch **52*a*. An alarm generator 21 is provided to produce an alarm sound in response to the detection signal from the disconnect signal detector; a first charging-discharging circuit 35*a* is connected to the DC power source through a first transistor 60 which is turned on when the push-button switch is depressed; a first Schmitt trigger circuit 45*a* transmits a lighting signal to the luminous element and also transmits a connect signal to the disconnect signal detector only for a time period set by the first charging-discharging circuit. The first Schmitt trigger circuit also transmits a disconnect signal to the disconnect signal detector after the period se by the first charging-discharging circuit. A second charging-discharging circuit 35*b* is connected to the DC power source through a second transistor 61 to be turned on when the push-button switch is operated; and a second Schmitt trigger circuit 45*b*** is provided to provide a signal to cause the alarm generator to produce the alarm sound to indicate the start of alarm cancellation, the second Schmitt trigger circuit provides the signal only for the duration of a time period set by the second charging-discharging circuit.

When a store clerk has to disconnect the connector of the alarm cord to take out an article, the store clerk is first required to depress the push-button switch for alarm cancellation. Depressing the push-button causes the first and the second transistors to be turned on for a while, respectively, and this causes the first and the second charging-discharging circuits, serving as the timers (ex. timer for 30 second and timer for 3 seconds), to generate the respective trigger signals.

While the second charging-discharging circuit (ex. the 3 second timer) is in operation, a pulse signal is generated 3 times from the alarm generator to cause the buzzer to be actuated 3 times to indicate the start of alarm cancellation.

While the first charging-discharging circuit (ex. 30 second timer) is in operation, not only is the LED lit to indicate that the alarm is cancelled but also the signal at the cord terminal is kept at "High" level. Thus, the alarm sound will not be produced even when the connector is disconnected.

When the connector is reconnected while the first charging-discharging circuit (ex. 30 second timer) is in operation, the alarm sound will not be produced even if the 30 second time period times out.

If anyone attempting to steal some goods has cut off the alarm cord or disconnected to connector without depressing the push-button switch for a cancellation, the thyristor is turned on, and the pulse signal is generated from the alarm generator to cause the buzzer to produce the intermittent sound continuously. Even if the burglar quickly reconnects the connector, the buzzer will continue to produce the alarm sound unless the thyristor is reset.

In case the first and the second charging-discharging circuits (ex. 30 second timer and 3 second timer) are actuated first by depressing the push-button for cancellation before disconnecting the cord connector, and the connector is left disconnected for a time period exceedin 30 seconds, the cancellation condition will become invalid to cause the buzzer to start.

DETAILED DESCRIPTION

Figure 1:
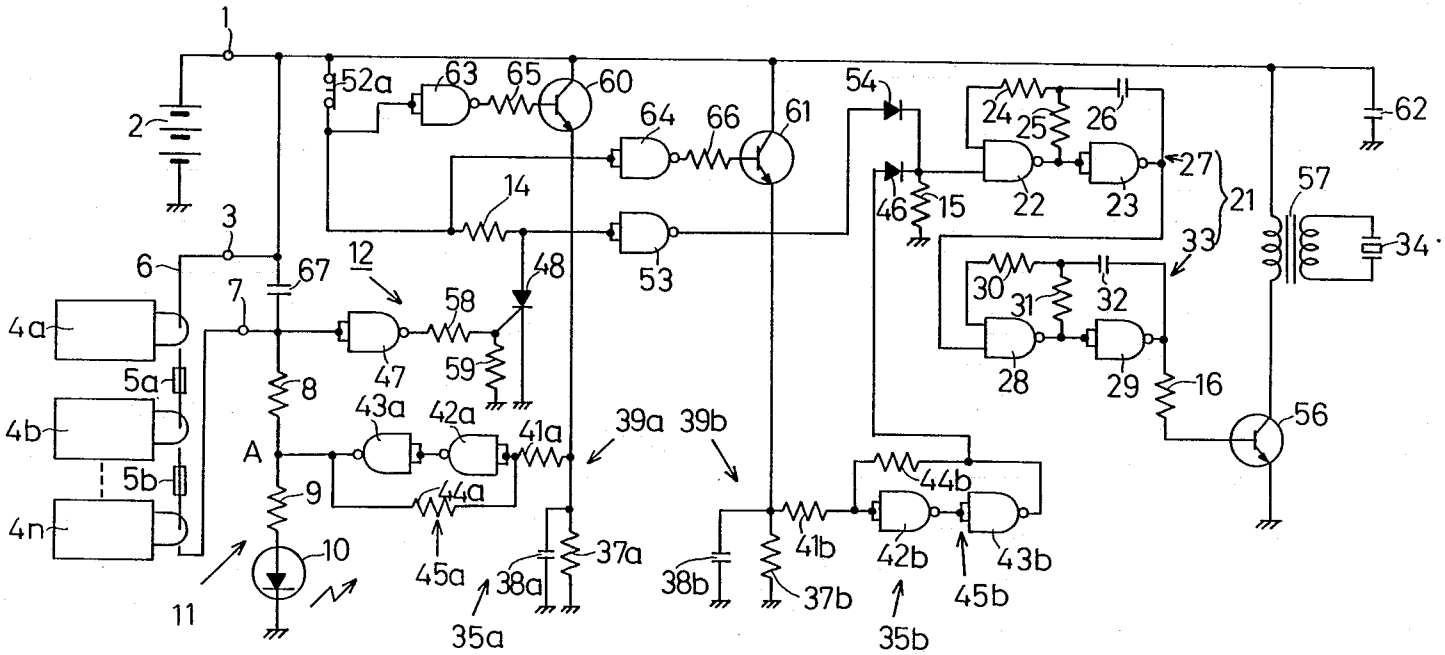
FIG. 1 is an electric circuit diagram including a logical circuit of an alarm system as an embodiment of the present invention.
Figure 2:
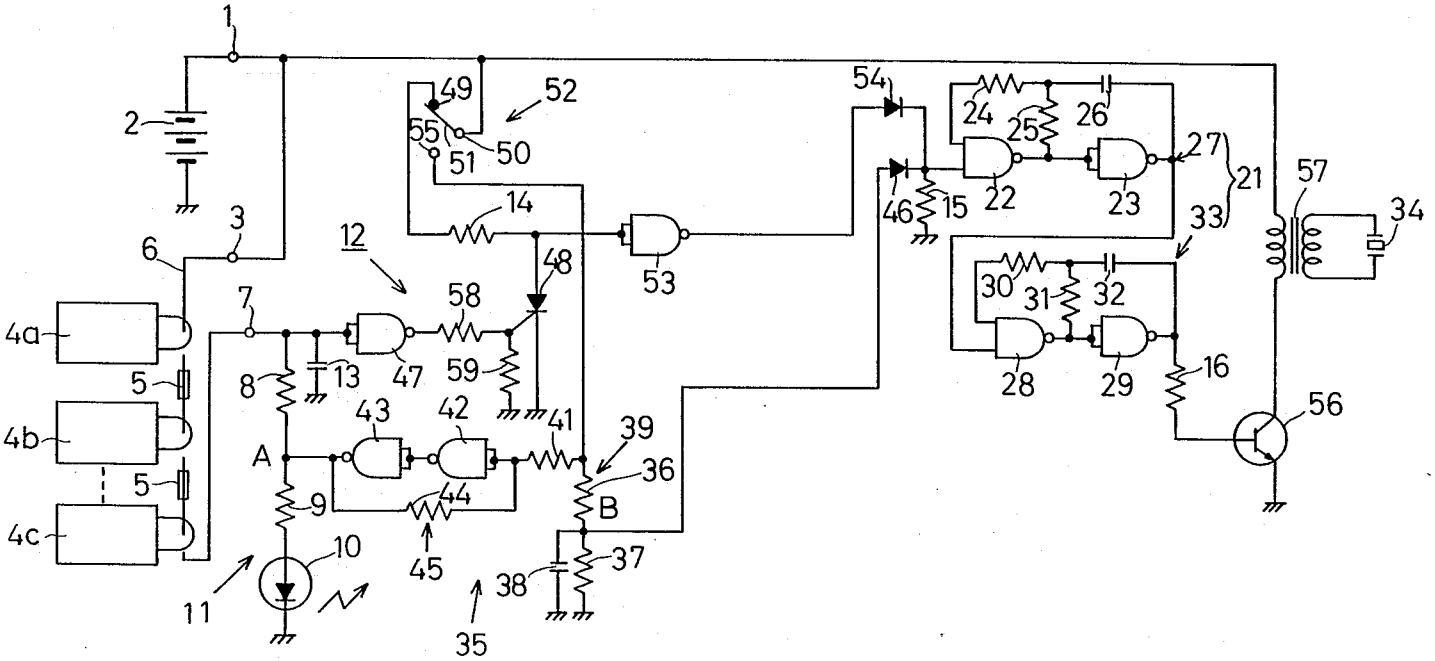
FIG. 2 is the circuit diagram of the conventional alarm system.

The first embodiment of the present invention will be explained hereunder in reference to the relevant drawing. In this drawing, the same components or parts are represented by the common numerals (or codes).

The drawing illustrating the first embodiment is an electric circuit diagram including some logical circuits, wherein the numeral 1 denotes the terminal of a DC power source 2. The power source terminal 1 is connected to an alarm cord 6 through a connection terminal 3. The alarm cord 6 includes connectors **5*a*, 5*b* . . . 5*n*, each consisting of a pin and a jack to be used when attaching or detaching the cord 6 to or from the articles to be guarded. The alarm cord 6 is passed through or wound round the parts, e.g., the grips of the articles, to guard the articles from theft and is also connected to a connection terminal 7, a high resistor 8, a protective resistor 9 and a luminous element 10 (consisting of an LED 10 whose cathode is grounded) in series sequence to constitute a closed circuit 11**.

The numeral 12 denotes the disconnect signal detector for detecting the disconnection of the alarm cord 6 constituting the closed circuit 11. The disconnect signal detector 12 mainly consists of an inverter circuit 47, a thyristor 48 using the output of the inverter circuit as the gate signal thereof and an automatic reset type push-button switch **52*a*. More particularly, the input side of the inverter circuit 47 is connected to the connection terminal 7 whereas the output side is grounded through resistors 58 and 59. The junction of the resistors 58 and 59 is connected to the gate of the thyristor 48. The cathode of the thyristor 48 is grounded, whereas the anode is connected not only to the contact of the push-button switch 52*a* through a resistor 14 but also to first and second transistors 60 and 61 through inverter circuits 63 and 64 and resistors 65 and 66**, respectively.

The anode of the thyristor 48 is also connected to an alarm generator 21, which produces the alarm sound in response to the detection signal, which is applied thereto through an inverter circuit 53 and a diode 54. The alarm generator 21 comprises a first oscillation circuit 27 consisting of a resistor 15, an AND gate 22, an inverter circuit 23, resistors 24 and 25 and a capacitor 26. The second oscillation circuit 33 consists of an AND gate 28, an inverter circuit 29, resistors 30 and 31 and a capacitor 32, which is connected to the output side of the first oscillation circuit 27. Additionally, there is provided a transistor 56 whose base is connected to the output side of the second oscillation circuit 33 through a resistor 16; an output transformer 57 connected to the collector of the transistor 56; and a buzzer 34 consisting of a piezoelectric element connected to the transformer 57 to produce the alarm sound.

35*a* denotes an alarm cancellation time setter. The alarm cancellation time setter 35*a* comprises a first charging discharging circuit 39*a*, which serves as a 30 second timer and consists of a resistor 37*a* serially connected to the emitter of the first transistor 60 and a capacitor 38*a* parallelly connected to the resistor 37*a*, and a first Schmitt trigger circuit 45*a* consisting of inverter circuits 42*a* and 43*a* and a resistor 44*a*, which are connected to the first charging-discharging circuit 39*a* through resistor 41*a*.

The output side of the first Schmitt trigger circuit 45*a* of the alarm cancellation time setter 35*a* is connected to the connection point A between the high resistor 8 of the closed circuit 11 and the protective resistor 9 so that not only the signal for enabling the disconnect signal detector 12 to discontinue generating the detection signal can be transmitted but also the signal for causing the LED 10 to be lit.

The emitter of the second transistor 61 is connected to alarm cancellation start signal generator 35*b*. The alarm cancellation start signal generator 35*b* comprises a second charging-discharging circuit 39*b*, which serves as a 3 second timer and consists of a resistor 37*a* and a capacitor 38*b*, and a second Schmitt trigger circuit 45*b* consisting of a resistor 41*b* and inverter circuits 42*b* and 43*b* and a resistor 44*b*.

A noise-suppression capacitor 67 is inserted between cord terminals 3 and 7.

The function of the alarm system having the above described composition will be explained hereunder.

When a store clerk has to take out an article 4*a* by disconnection the connectors 5*a*, 5*b* . . . of the cord 6, the clerk is first required to depress the push-button switch 52*a* to initiate alarm cancellation. The push-button switch 52*a* is reset automatically and at once when depressed.

Depressing said push-button switch 52*a* causes the first and the second transistors 60 and 61 to be turned on for a while respectively through the inverters 63 and 64, and thus causes the first and the second charging-discharging circuits 39*a* and 39*b*, serving as the timers, to generate the trigger signals.

Then, the first and the second Schmitt trigger circuits 45*a* and 45*b* are caused to operate for 30 seconds and 3 seconds respectively.

While the 3 second timer 39*b* is in operation, the pulse signal is generated n times (ex. 3 times) from the alarm generator 21 to turn on the drive transistor 56 3 times to cause the buzzer to be actuated 3 times. When the buzzer is started, other store clerks are able to check who has depressed the push-button switch 52*a*.

While the 30 second timer 39*a* is in operation, the LED 10 is kept lit to indicate that the alarm is cancelled currently, the signal at the cord terminal 7 is kept at "High" level. Thus, the inverter circuit 47 will not be reversed even if the connectors 5*a*, 5*b* . . . are disconnected.

When the connectors 51, 5*b* . . . are reconnected while the 30 second timer 39*a* is in operation, the inverter circuit 47 will not be reversed even if the 30 second timer 39*a* is up.

If anyone attempting to steal some goods has cut off the cord 6 or disconnected the connectors 5*a*, 5*b* without depressing the push-button switch 52*a* for cancellation, the level of the signal at the cord terminal 7 becomes "Low", whereas the level of the output of the inverter circuit 47 becomes "High" to cause the thyristor 48 to be turned on, whereby the output of the inverter circuit 53 becomes "High" to cause the alarm sound to be produced continuously from the buzzer 34. Even if the thief reconnects the connector 5*a* in haste, the alarm sound continues unless the thyristor 48 is reset by depressing the push-button switch 52*a*.

In case the connectors 5*a*, 5*b* . . . of cord 6 are disconnected after depressing the push-button switch 52*a* for cancellation to drive the 3 second timer 39*b* and the 30 second timer 39*a*, and the connectors 5*a*, 5*b* . . . are left disconnected even after the elapse of 30 seconds, the alarm cancellation state will become invalid to cause the buzzer to start.

Needless to mention, the time periods which can be set by the timers 39*a* and 39*b* are not limited to those indicated in the above.

Since the present invention is composed as described in the foregoing, the alarm current flowing through the closed circuit Z while the alarm system is in operation is as small as 4–6 μA, and this composition promises smaller power consumption, safer operation and sure operation at the time when the alarm cord is disconnected. Furthermore, the alarm system is not only capable of producing the alarm cancellation start sound at the time of the cancellation of the alarm but also is capable of lighting the LED, and thus it can be readily recognized whether the alarm system is in the alarm mode or the cancellation mode, to prevent the erroneous operation.

Moreover, with the alarm system not only can the number of times for actuating the buzzer be determined freely to indicate the start of the alarm cancellation, for example, 2 or 3 times, but also the time period for alarm cancellation required to release the articles from the guarded state can be set freely at any length such as 20 seconds or 30 seconds. Furthermore, the first and the second charging-discharging circuits constituting the timers can be energized by the current flowing through the transistors, and so a smaller push-button switch can be used.

What is claimed is:

1. An alarm system comprising:

(a) a closed circuit including an alarm cord, a high resistor and a luminous element which are sequentially connected to a DC power source means;

(b) a disconnect signal detector means for detecting disconnection of the alarm cord in the closed circuit and for outputting a detection signal, including (1) an inverter circuit means connected to the closed circuit and providing an output signal, (2) a thyristor to be actuated by application of the output signal of the inverter circuit means to a gate thereof, and (3) an automatic reset type push-button switch means inserted between an anode of the thyristor and the DC power source means;

(c) an alarm generator means for producing an alarm sound in response tot the detection signal from the disconnect signal detector means;

(d) a first charging-discharging circuit means connected to the DC power source means through a first transistor which is turned on when the push-button switch means of the disconnect signal detector means is operated;

(e) a first Schmitt trigger circuit means for transmitting a lighting signal to the luminous element in the closed circuit and also for transmitting a connect signal to the disconnect signal detector means only for a duration of a time period set by the first charging-discharging circuit means when the push-button switch means is operated, and for transmitting a disconnect signal to the disconnect signal detector means after expiration of the time period set by the first charging-discharging circuit means;

(f) a second charging-discharging circuit means connected to the DC power source means through a second transistor to be turned on when the push-button switch means is operated; and (g) a second Schmitt trigger circuit means for providing an alarm signal to cause the alarm generator means to produce the alarm sound to indicate a start of alarm cancellation, said second Schmitt trigger circuit means providing the alarm signal only for a duration of a time period set by the second charging-discharging circuit means when the push-button switch means is operated.

* * * * *